United States Patent [19]

Megerle et al.

[11] 4,358,094

[45] Nov. 9, 1982

[54] FURNACE SYSTEM FOR SMELTING ORE CONCENTRATE AND THE LIKE

[75] Inventors: Friedrich Megerle, Cologne; Heinz Cordewener, Troisdorf, both of Fed. Rep. of Germany

[73] Assignee: Klockner-Humboldt-Deutz AG, Fed. Rep. of Germany

[21] Appl. No.: 194,903

[22] Filed: Oct. 7, 1980

[30] Foreign Application Priority Data

Oct. 18, 1979 [DE] Fed. Rep. of Germany ..... 2942121

[51] Int. Cl.[3] ..... C21B 7/10

[52] U.S. Cl. ..... 266/190; 266/193; 266/194; 266/241; 432/233; 432/238; 373/76

[58] Field of Search ..... 266/194, 193, 190, 241; 13/32; 432/233, 238; 65/356, 355; 165/67, 137, 168; 122/6 A, 6 B

[56] References Cited

U.S. PATENT DOCUMENTS

| | | | |
|---|---|---|---|
| 1,703,520 | 2/1929 | Dovel | 266/194 |
| 1,906,695 | 11/1930 | Lufkin | 65/356 |
| 3,379,427 | 4/1968 | Zherebin et al. | 266/190 |
| 3,512,767 | 5/1970 | Gillum | 266/194 |
| 3,526,396 | 9/1970 | Paulus | 266/193 |
| 3,555,164 | 1/1971 | Kostin et al. | 13/9 |
| 3,593,975 | 7/1971 | White | 266/194 |

FOREIGN PATENT DOCUMENTS

| | | | |
|---|---|---|---|
| 502812 | 3/1939 | United Kingdom | 13/32 |

*Primary Examiner*—L. Dewayne Rutledge
*Assistant Examiner*—Alan E. Schiavelli
*Attorney, Agent, or Firm*—Hill, Van Santen, Steadman, Chiara & Simpson

[57] ABSTRACT

A furnace system for smelting ore concentrate and the like which includes a furnace housing provided with wall means which divide the housing into a smelting shaft, an exhaust gas shaft and a settling hearth. The settling hearth and the smelting shaft are separated by a partition wall preventing gaseous interaction therebetween but permitting liquid flow therebetween. In accordance with the invention, the partition wall between the exhaust gas shaft and the smelting shaft, as well as the wall between the settling hearth and the smelting shaft and exhaust gas shaft comprises a supporting frame on which there are a plurality of interengaged cooling elements which are releasably secured to the supporting frame and are provided with means for circulating a coolant therethrough.

10 Claims, 6 Drawing Figures

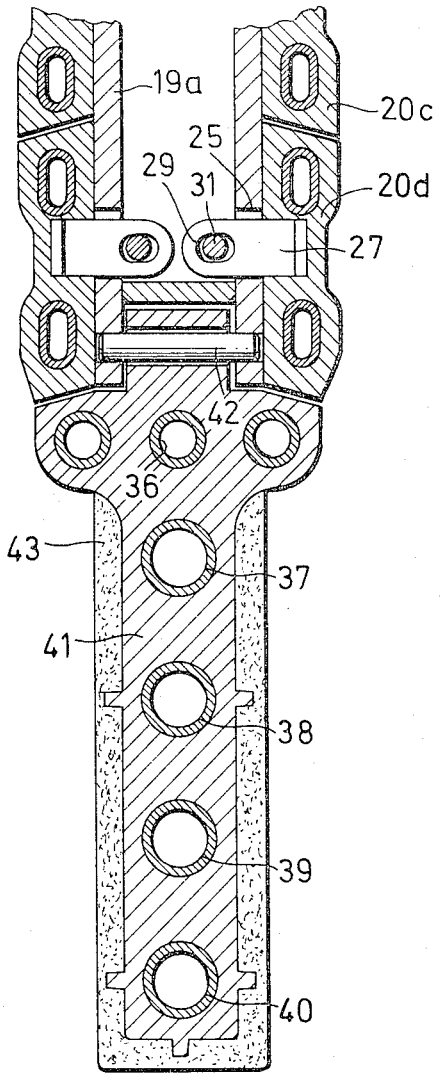
FIG. 5
FIG. 6
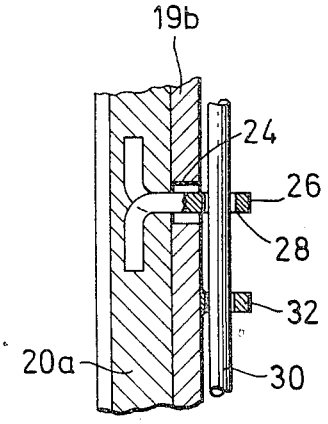

FURNACE SYSTEM FOR SMELTING ORE CONCENTRATE AND THE LIKE

BACKGROUND OF THE INVENTION

1. Field of the Invention

This invention is in the field of furnace systems for smelting ore concentrates and provides a novel system of partition walls to separate the various portions of the furnace from each other, the partition walls being modular in nature and being readily assembled and disassembled as required for replacement.

2. Description of the Prior Art

In a known pyrometallurgical furnace system as described, for example, in U.S. Pat. No. 3,555,164, fine-grained ore is continuously calcined and smelted in an oxygen-rich gas atmosphere. The molten mass and the gas formed as well as dust are separated from each other in a smelting chamber. The gas and dust are withdrawn in an exhaust gas shaft adjacent to the smelting chamber, and the molten mass and slag collected on the floor of the smelting chamber pass under a furnace partition which depends from the roof and dips into the molten mass. The molten mass and slag pass under the partition into a settling hearth for further treatment of the molten material and removal of the slag.

The furnace walls in such an installation come into contact with hot, corrosive gases as well as with hot metal or with a hot slag bath and so have to be absolutely fire resistant and capable of being cooled. In the prior art furnace, the partition dipping into the molten bath and extending over the entire width of the furnace for separating the settling hearth from the melt collecting space is a wall suspended from the ceiling of the furnace and provided with cooling channels. Such partition walls cannot be lined with brick, for example, because of the excessive wear due to the corrosive slag melt. As mentioned, such a partition must not only be cooled but it should be fashioned as a self-bearing structure. If the entire furnace partition were made of a single piece of a metallic cooling element, then the partition due to its weight and size could not as a practical matter be transported and assembled. Thermal stresses in the partition would not equalize, and worn parts of the partition could not be replaced. Alternatively, if the furnace partition were welded together from a plurality of metallic cooling elements, the welding at the construction site would involve considerable time and costs.

SUMMARY OF THE INVENTION

The present invention seeks to avoid these disadvantages and to create a furnace system wherein the walls, particularly the partitions subject to substantial thermal loads exhibit a high stability despite the existence of cooling means, are easy to assemble, are capable of equalizing thermal stresses, and have other advantages.

In accordance with the present invention, at least the load-bearing lower part of the furnace walls, particularly the furnace partitions, include a supporting structure to which individual cooling elements with coolant flowing therethrough are releasably secured, at least in the areas where the thermal stresses are the highest. As a rule, furnace partitions have high thermal loading on both sides so that the individual cooling elements and their coolant circulation means are releasably secured to both outside surfaces of the furnace supporting structure which, in the preferred form of the invention, takes the form of a hollow sheet steel box girder.

Assembly of the furnace wall of the present invention is quite simple. The cooling elements are not physically connected to one another so that extensive welding work is eliminated. Because of the releasable connection of the cooling elements to the supporting structure, the cooling elements can be quickly and simply replaced or they can be mutually interchanged since the individual elements can be made of identical size. The individual cooling elements need not be designed with excessive mass or bearing capabilities, since a separation between the cooling elements which have the cooling function and the supporting structure which has the support function is maintained. The cooling elements provide for the thermal protection of the supporting structure, and a fire-resistant masonry structure is not required. Because the connection between the cooling elements and the supporting structure is releasable, thermal stresses can be equalized particularly with differing thermal loads at both sides of the furnace partition. The improved furnace wall construction of the present invention need not extend over the overall height of a furnace partition but need only be present in the lower wall area which is subject to the greatest thermal stresses so that the furnace wall of the present invention can be designed as a self-bearing or supporting structure which is sufficiently solid so that other structural elements such as masonry with cooling pipes, a tubular membrane wall, or a furnace wall, or other wall structures can be erected thereon.

BRIEF DESCRIPTION OF THE DRAWINGS

The invention and other advantages are explained in greater detail based upon the embodiments schematically illustrated in the drawings. In these drawings:

FIG. 5 is an enlargement of the detail V of FIG. 3; and

FIG. 6 is a cross-sectional view along the line VI—VI of FIG. 4.

DESCRIPTION OF THE PREFERRED EMBODIMENTS

Figure 1:
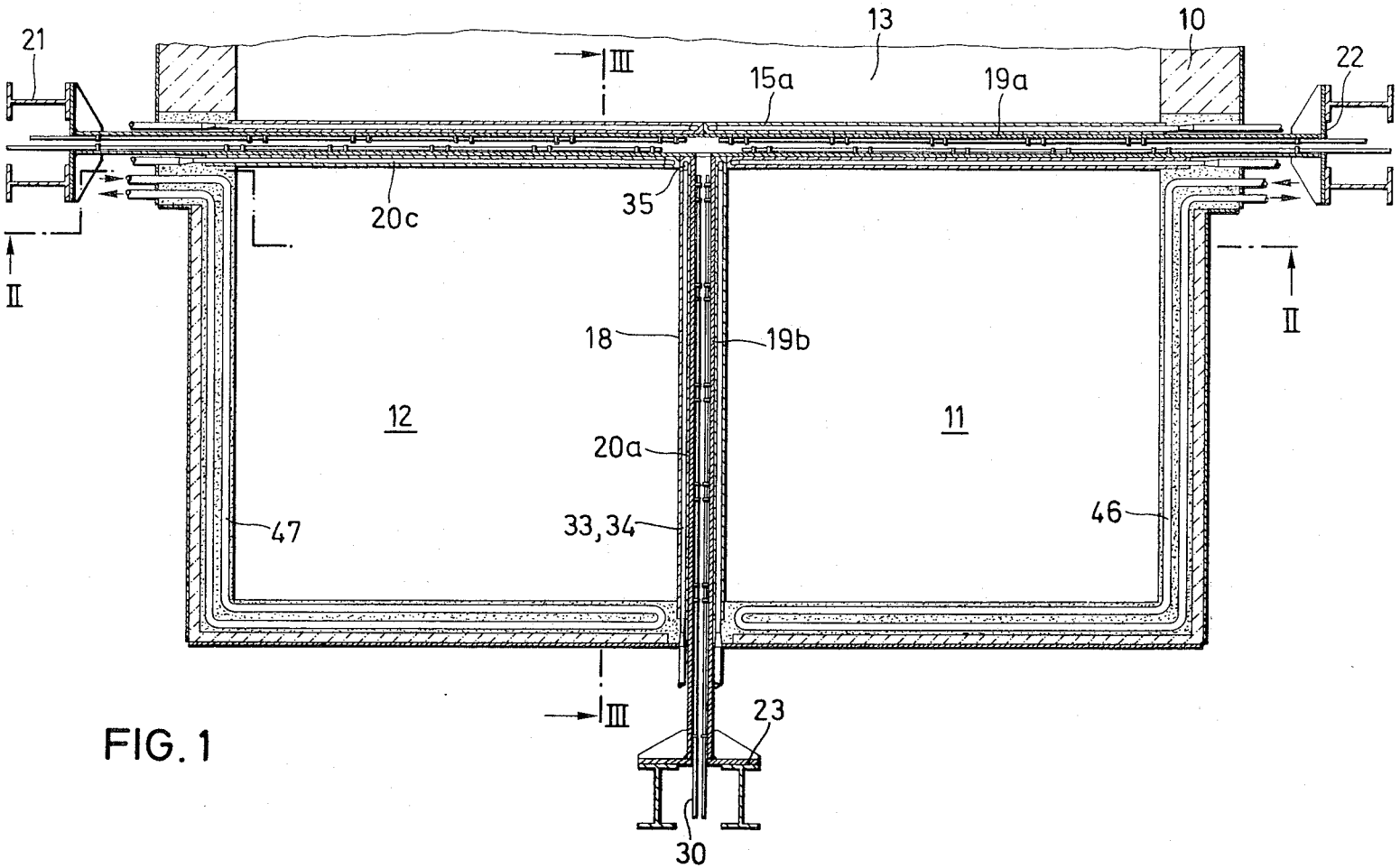
FIG. 1 is a horizontal cross section through a pyrometallurgical furnace system employing the present invention, taken along the line I—I of FIG. 2.
Figure 2:
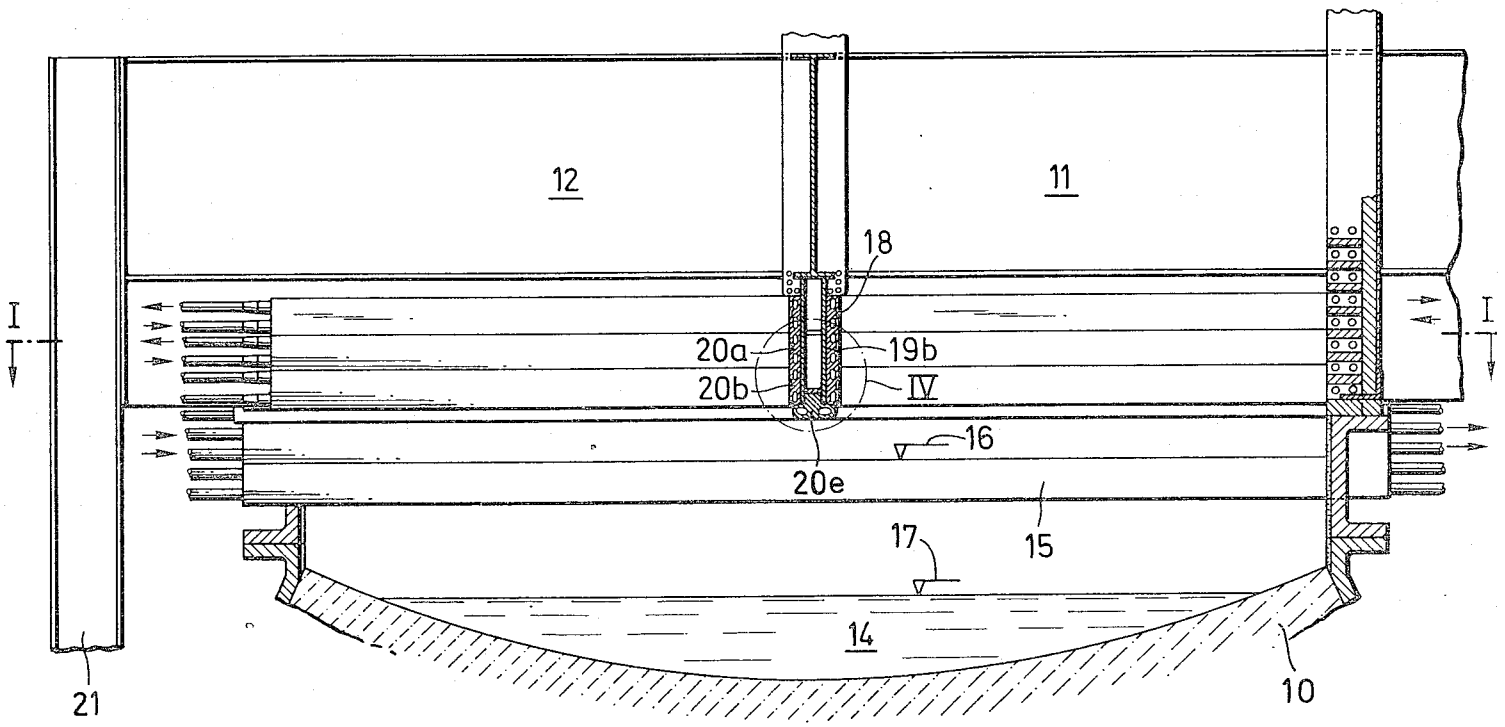
FIG. 2 is a vertical cross section through the furnace system taken along the line II—II of FIG. 1.
Figure 3:
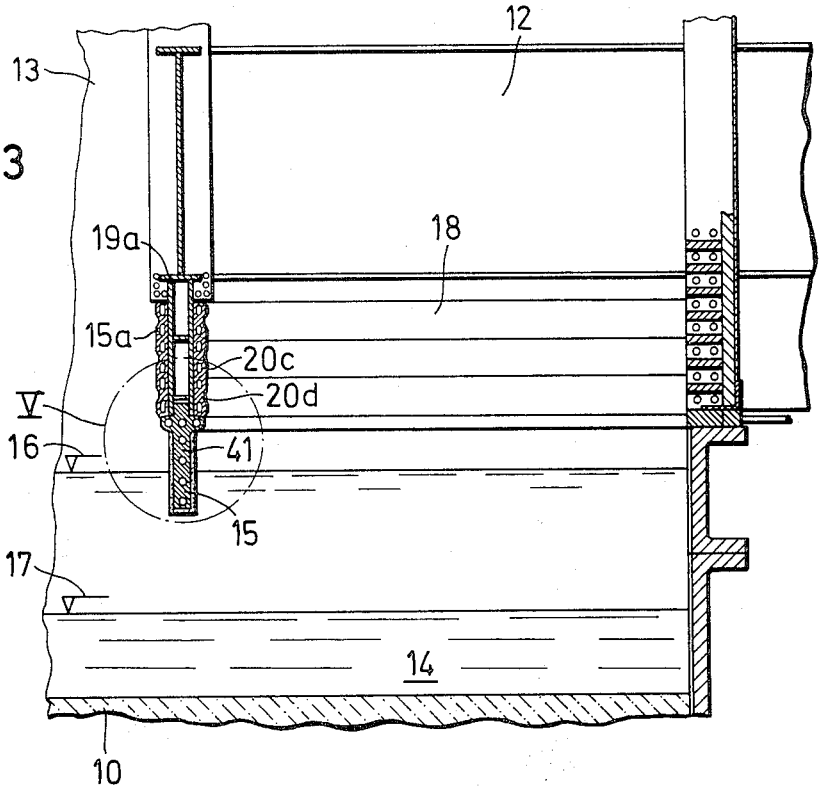
FIG. 3 is a vertical cross-sectional view taken along the line III—III of FIG. 1.

In FIGS. 1 through 3 there is shown a pyrometallurgical furnace system which is intended to melt fine-grained, sulfidic lead ore concentrates. There is provided a common housing 10 in which there is disposed three isolated compartments, consisting of a flash melting shaft 11, an exhaust gas shaft 12 and a settling hearth 13 for the further treatment of the smelt. The sulfidic ore concentrate is injected into the vertical melting shaft 11 from the top of the furnace, together with a stream of technically pure oxygen.

The ore concentrate is calcined and melted in the smelting shaft 11 by means of almost instantaneous heating to high temperatures in fractions of a second while the concentrate is suspended in the gas stream. The combustion of the sulfide sulfur and, if necessary, other oxidizable components in the oxygen atmosphere supplies sufficient heat to permit the calcining and melting operation to proceed autogeneously. The melt is collected in a smelt collecting space 14 and the exhaust gas together with the dust formed is withdrawn toward the top of the furnace through the exhaust gas shaft 12. A primary slag forms on the collected smelt in the collecting space 14. The smelt flows under the lower edge of a vertical partition 15 which dips into the molten bath or into a slag bath from the top and flows into the settling hearth 13. The smelt is reduced in the settling hearth 13 from which the lead can be separated, and any secondary slags can be separately removed from the settling hearth. The surface of the slag bath and the surface of the lead bath indicated at element 17 are of the same height in the smelt collecting space 14 as they are in the settling hearth 13. The partition 15 prevents the mixing of gases from the oxidation zone on one side and the reduction zone on the other, making it possible to use independent atmospheres in both zones. The smelting shaft 11 and the exhaust gas shaft 12 are separated from one another by means of a furnace partition 18. The exhaust gas is drawn off from the smelting shaft 11 into the exhaust gas shaft 12 through the spacing between the surface of the slag bath 16 and the lower edge of the furnace partition 18.

Two vertical furnace partitions 15*a* and 18 perpendicular to one another are under a very high thermal stress and require cooling. In accordance with the present invention, at least the load-bearing, lower part of these furnace partitions consist of a supporting structure 19*a* and 19*b*, respectively, which consists of a hollow box girder made of sheet steel elements. On the outside surfaces of the elements there are individual cooling elements 20*a*, 20*b*, 20*c*, and 20*d*, which are arranged for the passage of coolant and are releasably secured thereto. The two hollow box girders 19*a* and 19*b* are abutted with one another in the form of a T and are welded to form the supporting structure for the two furnace partitions 15 and 18. The T-shaped box girder support structure 19*a*, 19*b* is supported at its three free ends by means of supports 21, 22, and 23 located outside the furnace.

The cooling elements 20*a*, 20*b*, etc., preferably consisting of copper, are in the shape of horizontally disposed beams. At their back sides they carry brackets 26 and 27 which are inserted through apertures 24, 25 of the box girder 19*a*, 19*b* whose ends are provided with longitudinal slots 28, 29 aligned along the horizontal direction. Horizontal locking bars 30, 31 are inserted to releasably lock the structure together to the hollow box girder. It can be seen from FIG. 6 that the bracket 26 as well as other brackets can be formed as brackets extending into the copper material of the cooling elements. It can also be seen that the box girders contain lugs 32 welded to the inside through which the lock bars are inserted and which, as shown in FIG. 1, extend toward the outside up to the three supports 21, 22, 23 of the supporting structure. In this manner, the individual cooling elements can be very easily and quickly suspended loosely from the supporting structure. After they are suspended, the cooling elements fit flush against the two outside surfaces of the box girders 19*a*, 19*b* so that a good thermal conduction by means of the cooling elements is guaranteed.

The beam-shaped cooling elements 20*a* through 20*d* each provide a lower coolant circulating conduit 33 and an upper coolant circulating conduit 34 connected together at their ends by means of a U-shaped fitting 35 so that the cooling agent, usually water, flows through the individual cooling elements in serpentine or hairpin fashion. The intake and discharge directions of the cooling agent are indicated by means of arrows in FIG. 2. The cooling conduits 33, 34, can consist of a flat-rolled copper tube which is embedded into the body of the copper cooling elements.

Figure 4:
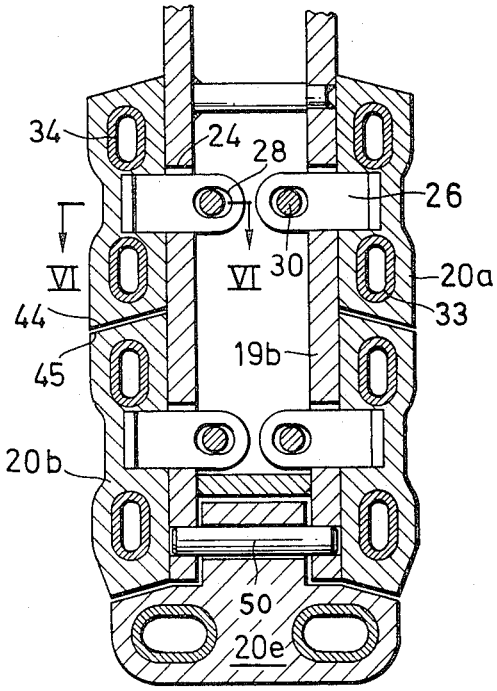
FIG. 4 is an enlargement of the detail IV of FIG. 2.

The lower portion of the box girder 19*b* of the furnace partition 18 which separates the exhaust gas shaft 12 from the smelting shaft terminates in a cooling element 20*e* (FIG. 4) in which the conduits for circulating the coolant are in parallel, horizontally spaced relation. The cooling element 20*e* is releasably suspended from the box girder 19*b* by means of a plurality of pins 50.

The lower end of the box girder 19*a* of the furnace partition 15*a* which separates the smelting shaft and/or the exhaust gas shaft 12 from the settling hearth 13 terminates in a cooling element 41 (FIG. 5) which dips into the smelt and is provided with a plurality of horizontally extending, vertically aligned conduits 36 through 40 which lie superimposed over one another. The cooling element 41 extends over the overall furnace width and is supported at both ends. In order to prevent a potential sagging, the cooling element 41 is also suspended from the box girder 19*a* by means of a plurality of pins 42. The cooling element 41 likewise preferably consists of copper and is provided with a fire-resistant monolithic lining material 43 at its outside surfaces. This material is replaced by a slag layer upon operation of the furnace.

The cooling elements suspended from the supporting structures are of identical size and are thus interchangeable, and do not touch one another. The confronting surfaces 44, 45 of the adjacent cooling elements are preferably sloped obliquely toward the bottom from the inside toward the outside so that adjacent cooling elements can mutually fix each other in operation. The outside surfaces of the furnace partitions 15*a* and 18 can also be protected by means of a fire-resistant monolithic lining. Cooling tubes 46, 47 are embedded in the fire-resistant material of the furnace outside walls which are subject to less thermal load, so that the furnace separating walls 15*a*, 18 which are under a higher thermal load are cooled to a correspondingly greater degree as a result of the presence of the metallic cooling elements whereas the outside furnace walls which are under a lesser thermal load are cooled to a corresponding lesser degree. The thermal dissipation from the furnace walls can be individually adjusted depending on the thermal load of the walls by means of a greater or lesser accumulation of metallic cooling element material at the wall.

The furnace partitions need not be protected thermally with the suspended cooling elements over the entire wall height but only at their lower, thermally loaded ends so that the improved furnace wall construction is ideally suited as a supporting structure or bearing structure which is solid enough so that other structural elements such as masonry, tubular membrane walls, or other walls can be erected thereon. The furnace partitions 15, 15*a* extend over the entire furnace width which may, for example, be 8 meters or so, and are held stable with the box girders 19*b* in the critical central range proceeding from the furnace partition 18 and running perpendicular thereto. The furnace construction is thereby improved in terms of overall stability.

It should be evident that various modifications can be made to the described embodiments without departing from the scope of the present invention.

We claim as our invention:

1. In a furnace system for smelting ore concentrate and the like including a furnace housing having wall means dividing the same into a smelting shaft, an exhaust gas shaft and a settling hearth, said settling hearth and said smelting shaft being separated by a partition wall preventing gaseous interaction therebetween but permitting liquid flow therebetween, the improvement which comprises:

as said partition wall:

a supporting frame comprising a hollow box girder, and a plurality of cooling elements at least in the areas of highest thermal stress releasably secured to both sides of said hollow box girder, and means for circulating a coolant through said cooling elements.

2. A furnace system according to claim 1 in which:

a first supporting frame extending the width of the furnace housing to separate said smelting shaft and said exhaust gas shaft on one side from the settling hearth on the other side, and a second supporting frame extending perpendicular to said first supporting frame to separate said smelting shaft from said exhaust gas shaft, and means outside said furnace housing for supporting the free ends of said first and second supporting frames.

3. A furnace system according to claim 1 in which:

said cooling elements are in the form of superimposed horizontal beams, brackets carried by said beams and arranged to extend through apertures in said supporting frame, and locking means releasably securing said brackets to said supporting frame.

4. A furnace system according to claim 3 in which:

said locking means includes locking bars arranged to extend through apertures provided in said brackets.

5. A furnace system according to claim 3 in which:

each cooling element includes a pair of fluid conduits in superposed vertical relation for circulating coolant therethrough.

6. A furnace assembly according to claim 2 in which:

said second supporting frame carries an additional cooling element, said additional cooling element having a pair of coolant circulating conduits in horizontally spaced parallel relation.

7. A furnace system according to claim 2 in which:

said first supporting frame carries an additional cooling element arranged to be immersed in the smelt and including a plurality of coolant circulating conduits in vertically spaced relation.

8. A furnace system according to claim 3 in which:

each of said beams has angularly disposed surfaces arranged to face angularly disposed surfaces on adjoining beams in slightly spaced relation.

9. A furnace system according to claim 3 in which:

each of said beams is of identical size and is therefore interchangeable.

10. In a furnace system for smelting ore concentrate and the like including a furnace housing having wall means therein subject to high thermal stresses at at least one surface thereof, the improvement which comprises:

said wall means being formed as a hollow box girder, a plurality of individual cooling elements each releasably secured in flat, abutting face-to-face relationship to the surface of the wall subject to high thermal stresses, and means for circulating a coolant through each of said cooling elements.

* * * * *